US005798324A

United States Patent [19]

Svoboda

[11] Patent Number: 5,798,324

[45] Date of Patent: Aug. 25, 1998

[54] GLASS CLEANER WITH ADJUSTABLE RHEOLOGY

[75] Inventor: George J. Svoboda, Whitefish Bay, Wis.

[73] Assignee: S.C. Johnson & Son, Inc., Racine, Wis.

[21] Appl. No.: 628,877

[22] Filed: Apr. 5, 1996

[51] Int. Cl.[6] ..... C11D 1/12; C11D 1/88; C11D 3/43

[52] U.S. Cl. ..... 510/182; 510/475; 510/477

[58] Field of Search ..... 510/180–2, 475, 510/477

[56] References Cited

U.S. PATENT DOCUMENTS

| | | | |
|---|---|---|---|
| 3,939,090 | 2/1976 | Zmoda | 134/40 X |
| 3,950,260 | 4/1976 | Eldib | 252/89 R |
| 4,244,840 | 1/1981 | Straw | 252/540 |
| 4,315,828 | 2/1982 | Church | 252/153 |
| 4,414,128 | 11/1983 | Goffinet | 252/111 |
| 4,576,744 | 3/1986 | Edwards et al. | 252/554 |
| 4,627,931 | 12/1986 | Malik | 252/153 |
| 4,673,523 | 6/1987 | Smith et al. | 15/104.93 |
| 4,690,779 | 9/1987 | Baker et al. | 252/546 |
| 4,749,509 | 6/1988 | Kacher | 252/139 |
| 4,787,998 | 11/1988 | Rennie et al. | 252/174.11 |
| 4,863,629 | 9/1989 | Osberghaus et al. | 252/162 |
| 4,983,317 | 1/1991 | Requejo et al. | 252/174.24 |
| 5,350,541 | 9/1994 | Michael et al. | 252/549 |
| 5,362,415 | 11/1994 | Egraz et al. | 252/174.24 |
| 5,376,298 | 12/1994 | Michael | 252/153 |
| 5,437,807 | 8/1995 | Garabedian, Jr. et al. | 252/153 |
| 5,454,983 | 10/1995 | Michael et al. | 510/103 X |
| 5,534,198 | 7/1996 | Masters et al. | 510/182 |
| 5,705,470 | 1/1998 | Faris | 510/403 |

FOREIGN PATENT DOCUMENTS

| | | |
|---|---|---|
| 0 216 416 | 4/1987 | European Pat. Off. . |
| 0527625A2 | 8/1992 | European Pat. Off. . |
| 0647706A2 | 10/1994 | European Pat. Off. . |
| 2166153 | 10/1985 | United Kingdom . |

OTHER PUBLICATIONS

Soap/Cosmetics/Chemical Specialties (Sep. 1995, p. 127).
General Purpose Spray–and–Wipe Cleaner (Mar. 1994, The BFGoodrich ; Company, Specialty Chemicals).
Rheology of Carbopol Polymers (Apr. 1994, The BFGoodrich Company, Specialty Chemicals, Bulletin DET–7)).
Yield Value and Suspending Ability of Carbopol Polymers (Dec. 1994, BFGoodrich Specialty Chemicals; Bulletin DET–3).

*Primary Examiner*—Michael Lusignan

[57] ABSTRACT

An aqueous glass cleaning composition with optimal vertical cling and ease of use properties contains at least one compound selected from the group consisting of nonionic surfactants, linear alcohols, an organic ether having the formula:

$$R_1—O—R_2$$

wherein $R_1$ is a $C_1$–$C_8$ linear, branched or cyclic alkyl or alkenyl optionally substituted with —OH, and $R_2$ is a $C_1$–$C_6$ linear, branched or cyclic alkyl or alkenyl substituted with —OH; a synthetic polymeric agent having a high thickening efficiency; and an anti-streaking alcohol.

21 Claims, 3 Drawing Sheets

GLASS CLEANER WITH ADJUSTABLE RHEOLOGY

BACKGROUND OF THE INVENTION

1. Field of the Invention

The present invention relates generally to compositions for cleaning glass surfaces. In particular, the present invention relates to improved thickened glass cleaning compositions.

2. Brief Description of the Background Art

Typical prior art liquid glass cleaners are non-viscous and utilize a water-based system with a detergent and an organic solvent. For reasons of household safety and commercial acceptance, glass cleaners are nearly universally water-based. Generally non-viscous cleaners will run down a vertical surface before the consumer can wipe the composition from the surface. Accordingly, there is a need for a cleaning composition which will maintain a longer vertical cling than traditional non-viscous glass cleaners.

Polymeric thickeners have been used to thicken water-based cleaning compositions. However using these polymers in glass cleaning compositions has proven problematic. For example, using too high a levels of these polymers can result in streaking and hazing due to the residue left by the polymer. In addition, increasing polymer levels can undesirably increase the lateral or "rub-out" friction created between the cleaning implement such as a paper towel and the glass surface during the cleaning process. Further, increasing the polymer level may limit the ability of the cleaning composition to be sprayed through a conventional trigger sprayer dispenser.

SUMMARY OF THE INVENTION

It is an object of the present invention to provide a cleaning compositions having a non-runny viscosity, that can also be readily wiped off a surface, sprayed through a conventional trigger sprayer, and provide substantially streak-free cleaning of a surface.

This object and others are provided by a novel aqueous composition which comprises a polymeric agent with high thickening efficiency, at least one compound selected from the group consisting of a glycol ether, a nonionic surfactant, a linear alcohol and mixtures thereof, and an anti-streaking alcohol wherein the composition has a pH of at least 7.

DETAILED DESCRIPTION OF THE INVENTION

Figure 1:
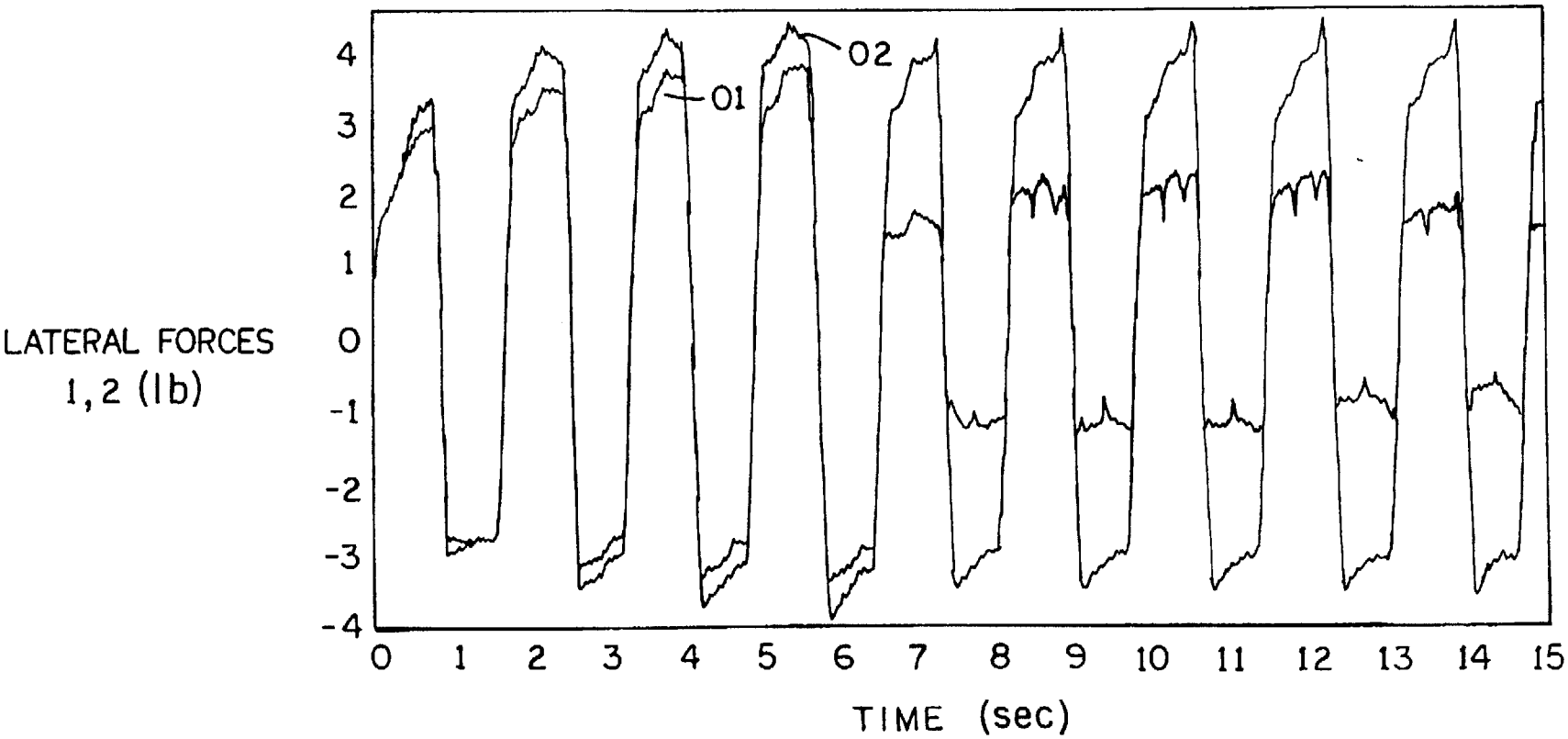
FIGS. 1, 2, 3 illustrate the rub-out friction of glass cleaning compositions of the present invention and the prior art.

The above features and advantages are provided by the present invention which relates most generally to an aqueous cleaning composition comprising a combination of a synthetic polymeric agent with high thickening efficiency, at least one compound selected from the group consisting of organic ethers, nonionic surfactants and linear alcohols, and an anti-streaking alcohol. If desired, these compositions may also contain one or more of the following: a fragrance, an organic solvent, and coloring. The composition may also contain other conventional materials including, but certainly not limited to; ammonia, vinegar, chelating agents, pH modifiers, anti-microbial compounds, etc.

In order to attain a sufficient viscosity to maintain sufficient cling on a vertical surface, the present invention contains at least one synthetic polymer with high thickening efficiency. A synthetic polymer having high thickening efficiency provides a viscosity greater than 5 cps when present in water an amount of about 0.1% by weight in water at a pH of at least 7.

Typical synthetic polymers having high thickening efficiency include, but are not limited to, polyacrylic acid polymers available under the tradenames Acritamer 501E, Acritamer 504E, Acritamer 505E, Acritamer 934, Acritamer 940 and Acritamer 941 from R.I.T.A. Corp. and Novaprint AB, Novaprint AV, Novaprint CL, Novaprint HV, Novaprint K, Novaprint LR and Novaprint WF from 3-V Inc.; acrylic copolymers available under the tradename Acusol 830 from Rohm and Haas Co. and Alcogum L from Alco Chemical Corp.; associative acrylic copolymers such as Acusol 820 and Acusol 823 from Rohm and Haas; crosslinked polyacrylic acid polymers such as Carbopol® ETD 2020, Carbopol® ETD 2050, Carbopol® 643, Carbopol® 645, Carbopol® 647, Carbopol® 676, Carbopol® 681-X1, Carbopol® 691, Carbopol® 694, Carbopol® 934 and 934P, Carbopol® 940 and 941, Carbopol® 980 and 981 and Carbopol® 1382, Carbopol® 1623, Carbopol® ETD 2001, Carbopol® ETD 2690, Carbopol® ETD 2691, Carbopol® ETD 2623, Carbopol® 2984 and Carbopol® 5984 from B. F. Goodrich Co. Preferably the synthetic polymer is a polyacrylic acid polymer or polyacrylic acid copolymer available under the tradenames Carbopol® ETD 2691 and Carbopol® ETD 2623 from B. F. Goodrich Co.

In the present invention, the polymer is present in an amount of about 0.1 or less total weight percent, preferably from about 0.02 to about 0.1 total weight percent, and most preferably from about 0.05 to about 0.09 total weight percent.

The present invention relates to the surprising discovery that certain glycol ethers, nonionic surfactants, and linear alcohols, when combined with an anti-streaking alcohol, couple with the synthetic polymer and markedly increase the viscosity of glass cleaning compositions, provide substantially streak-free cleaning and reduce the rub-out friction of glass cleaning compositions.

Rub-out friction refers to the friction created between the cleaning implement, such as a paper towel, and the glass surface during the cleaning process. This friction can be determined by measuring the lateral force required to move a paper towel across a polished glass surface at a downward (normal) force of 5 lb.

The organic ethers according to the present invention are represented by the following Formula (I):

$$R_1—O—R_2 \quad (I)$$

wherein $R_1$ is a $C_1$–$C_8$ linear, branched or cyclic alkyl or alkenyl optionally substituted with —OH, —$OCH_3$, or —$OCH_2CH_3$ and $R_2$ is a $C_1$–$C_6$ linear, branched or cyclic alkyl or alkenyl substituted with —OH.

Preferably, $R_1$ is an optionally substituted $C_3$–$C_6$ alkyl or alkenyl, and $R_2$ is a monosubstituted $C_2$–$C_4$ linear or branched alkyl or alkenyl.

More preferably, $R_1$ is an unsubstituted or monosubstituted linear or branched $C_3$–$C_6$ alkyl, and $R_2$ is a monosubstituted $C_2$–$C_4$ linear or branched alkyl.

Even more preferably, $R_1$ is an unsubstituted n-$C_3$–$C_4$ or n-$C_6$ linear alkyl or $$-CH_2\underset{\underset{OH}{|}}{C}HCH_3,$$

and $R_2$ is $-CH_2CH_2OH$ or $$-CH_2\underset{\underset{OH}{|}}{C}HCH_3.$$

Suitable glycol ethers include ethylene glycol n-hexyl ether, ethylene glycol n-butyl ether, dipropylene glycol methyl ether, propylene glycol n-butyl ether, propylene glycol n-propyl ether and mixtures thereof. However, since ethylene-based glycol ethers may be in the future considered hazardous and/or environmental air pollutants based on their degradation products or toxicity, the propylene-based glycol ethers may be better suited for residential cleaning compositions, particularly when intended for indoor use. Dow Triad is an equal weight percentage mixture of dipropylene glycol methyl ether, propylene glycol n-butyl ether and propylene glycol n-propyl ether which is commercially available from Dow Chemicals.

In the present invention, the glycol ether(s) can be contained in any amount desired. Generally, these amounts will be selected to achieve good cleaning results and are commonly in the range from about 0.01 to about 5.0 total weight percent (hereinafter, all amounts are given in weight percent unless specified otherwise). Preferably, the glycol ether is employed in the range from about 0.1 to about 3.0 total weight percent and most preferably, in an amount of about 2.0 or less total weight percent.

Most preferably, the glycol ether is a combination of ethylene glycol n-hexyl ether employed in the range from about 0.01 to about 1.5 total weight percent and of ethylene glycol n-butyl ether from about 0.01 to about 3.5 total weight percent, more preferably ethylene glycol n-hexyl ether from about 0.1 to about 1.0 total weight percent and ethylene glycol n-butyl ether from about 0.1 to about 3.0 total weight percent, and most preferably a combination of ethylene glycol n-hexyl ether utilized in an amount from about 0.6 to about 0.9 total weight percent and ethylene glycol n-butyl ether utilized in an amount from about 0.8 to about 2.0 total weight percent.

Suitable nonionic surfactants for use in the present invention include ethoxylated long chain alcohols, propoxylated/ethoxylated long chain alcohols, such as Poly-Tergents® from Olin Corp. and Plurafac® from BASF Corp.; ethoxylated nonylphenols such as the Surfonic® N Series available from Texaco and the Igepal® CO Series from Rhone-Poulenc; the ethoxylated octylphenols, including the Triton X Series available from Rohm & Haas, the ethoxylated secondary alcohols, such as the Tergitol® Series available from Union Carbide; the ethoxylated primary alcohol series, such as the Neodols available from Shell Chemical; and the ethylene oxide propylene oxide block copolymers, such as the Pluronics available from B.A.S.F. Wyandotte, and mixtures thereof.

The nonionics and mixtures of nonionics having an average hydrophobic-lipophilic balance ("HLB") in the range of about 6 to about 14 are preferred. More preferably, the nonionics have an average HLB in the range of about 10 to about 13.

The most preferred nonionic surfactants include the ethoxylated primary alcohols and ethoxylated nonylphenols, as these materials have water dispensability, good detergency characteristics and good biodegradability. The particularly preferred nonionic surfactants are the ethoxylated nonylphenols having 9 to 15 moles of ethylene oxide, and particularly ethoxylated nonylphenols having 9 moles of ethylene oxide such as those available from Rhone-Poulenc under the trademarks Igepal® CO-630 and Igepal® CO-630EP. Additional particularly preferred nonionic surfactants are the $C_9$–$C_{15}$ linear alcohol ethoxylates, and particularly $C_{12}$–$C_{13}$ linear alcohol ethoxylates such as those available from Shell Chemical Co. under the trademarks Neodol® 23-12, and Neodol® 23-5.

Applicant has observed that an aqueous composition containing Igepal® 630 at an amount of about 0.01 total weight percent and about 0.07 total weight percent neutralized Carbopol® ETD 2623, more than doubled the viscosity of the composition from about 34 centipoise ("cps") to about 120 cps.

If utilized, the nonionic surfactant is generally present in an amount from about 0.001 to about 1.0 total weight percent, more preferably from about 0.01 to about 0.1 total weight percent, and more preferably from about 0.025 to about 0.05 total weight percent.

Linear alcohols suitable for use in the present invention are soluble in aqueous solution. Typical linear alcohols include, but are not limited to, 1-pentanol, 2-pentanol, 3-pentanol, n-hexanol, 1-heptanol, 2-heptanol, 3-heptanol and mixtures thereof. Preferably the linear alcohol is n-hexanol. If utilized, the amount of linear alcohol is dependent upon its solubility in aqueous solution. For example, 1-pentanol is typically present in an amount from about 0.001 to about 1.0 total weight percent.

Enhanced viscosity has also been observed when an oil-soluble or oil-miscible fragrance is employed in the compositions of the present invention. The fragrance is typically utilized in the present invention in amounts in the range from 0 to about 0.1 total weight percent, preferably in an amount from about 0.1 to about 0.01 total weight percent, and most preferably in an amount from about 0.025 to about 0.05 total weight percent.

Applicant has unexpectedly found that the addition of anti-streaking alcohols reduces the streaking potential of the glass cleaning compositions of the present invention without negatively affecting the viscosity or rub-out properties of the composition. This achieves an important and previously unavailable combination of benefits.

These anti-streaking alcohols include various monohydric alcohols, dihydric alcohols, trihydric alcohols and polyhydric alcohols.

The anti-streaking alcohols for use in the present invention are represented by the following Formula (II):

$$\begin{array}{ccccccccc} & & A & & E & & L & & \\ & & | & & | & & | & & \\ H & - & C & - & C & - & J & - & C & - & Q \\ & & | & & | & & | & & \\ & & D & & G & & M & & \end{array} \qquad \text{(II)}$$

wherein A, D, E, G, L and M are independently —H, $-CH_3$, —OH or $-CH_2OH$; J is a single bond or —O—; and Q is —H or a straight chain $C_1$–$C_5$ alkyl optionally substituted with —OH, with the proviso that:

(i) if Q is not an alkyl substituted with —OH, then at least one of A, D, E, G, L and M is —OH or $-CH_2OH$;

(ii) when only one of A and E is —OH and J is a single bond, D, G, L, M and Q may not be —H simultaneously;

(iii) when A, D, E, G and L are —H simultaneously, J is a single bond and M is $-CH_2OH$, Q may not be —H or $$-\underset{\underset{OH}{|}}{CH}CH_2CH_2CH_3;$$

and (iv) when J is single bond, none of E, G, L and M is $-CH_3$ or $-CH_2OH$ and Q is $-CH_2CH_2CH_2CH_3$, then at least two of A, D, E, G, I, and M are —OH; or at least one of A and D is —CH or $-CH_2OH$.

Preferably, at least one of A, D, E and G is —OH or $-CH_2OH$ and Q is —H or a straight chain $C_1$–$C_5$ alkyl optionally monosubstituted with —OH.

More preferably, one or two of A, D, E and G is —OH or $-CH_2OH$ and Q is —H or $-CH_2OH$.

Most preferably, one or two of A, D, E and G is —OH or $-CH_2OH$, J is —O—, L and M are independently —H or $-CH_3$ and Q is $-CH_2OH$.

The inventors have found that propylene glycol (1,2-propanediol), glycerin (1,2,3-propanetriol), n-hexanol, 1-pentanol, 2-pentanol, 3-pentanol, 1,3-butylene glycol (1,3 butanediol) and diethylene glycol (dihydroxy diethyl ether) function especially well to enhance the anti-streaking potential of the glass cleaning compositions of the instant invention.

Other alcohols were found functionally not to reduce streaking characteristics. These include 2-ethyl-1,3-hexanediol, 2,2,4-trimethyl-1,3-pentanediol, 1-heptanol, 2-heptanol and 3-heptanol. However, as described above linear alcohols such as 1-heptanol, 2-heptanol and 3-heptanol have been found to significantly increase the viscosity of thickened cleaning compositions.

In the present invention, the anti-streaking alcohol(s) will be employed in any desired amounts. Generally, these amounts will be selected to achieve reduction in streaking and/or hazing and are commonly in the range of from about 0.1 to about 1.0 total weight percent. Preferably, the anti-streaking alcohol is employed in the range of from about 0.1 to about 0.5 total weight percent and most preferably, about 0.125 total weight percent.

Applicants have also observed that although alkane sulfonate hydrotropes may also reduce the streaking potential of glass cleaning compositions, they have a tendency to reduce the viscosity of the composition. Alkane sulfonate hydrotropes for use in the present invention include, but are not limited to n-octyl and n-decyl sulfonates. Preferably the alkane sulfonate is an n-octyl sulfonate available under the tradename Witconate® NAS-8 from Witco Co. or Stepan® PAS-8 from Stepan Co. Typically, the alkane sulfonate, if utilized, is present in an amount on an actives basis from about 0.015 to about 0.08 total weight percent, more preferably from about 0.025 to about 0.05 total weight percent, and most preferably from about 0.035 to about 0.05 total weight percent.

The glass cleaning compositions according to the present invention may contain one or more anionic surfactants to adjust the surface tension of the composition. Suitable anionic surfactants include, but are not limited to, alkyl sulfates such as sodium lauryl sulfate, ammonium lauryl sulfate, and triethanolamine lauryl sulfate; alkyl aryl sulfonates such as sodium dodecyl benzene sulfonate and decyl (sulfophenoxy) benzene sulfonic acid disodium salt sold by Dow Corporation as Dow®Fax C10L; alpha olefin sulfonates; alkyl ethoxysulfates; ethoxylated alcohol sulfates such as ammonium laureth sulfate sold by Stepan Co. as Sterol CA-330, and mixtures thereof. Preferably the anionic surfactant is selected from sodium lauryl sulfate, triethanolamine lauryl sulfate, sodium dodecyl benzene sulfonate, and mixtures thereof. The anionic surfactant may also be a fluoro anionic surfactant such as 3M Fluorad® FC-129.

Generally, the use of cationic surfactants and cationic amphoteric surfactants will adversely impact the polymer, and reduce the final viscosity of the cleaning compositions. Accordingly, these surfactants should be avoided.

In the present invention, the anionic surfactant(s) will be employed on an active basis in the range from 0 to about 0.20 total weight percent, preferably in the range from about 0.003 to about 0.15 total weight percent and most preferably in the range from about 0.03 to about 0.12 total weight percent. Applicant has found that the use of anionic surfactants above about 0.02 total weight percent will unacceptably degrade the viscosity of the composition.

In the present invention, the fluoro anionic surfactant will be employed on an active basis, in an amount range from 0 to about 0.05 total weight percent, preferably in an amount from about 0.005 to about 0.05 total weight percent, more preferably in an amount from about 0.00625 to about 0.025 total weight percent, and most preferably in an amount of about 0.00625 total weight percent.

The glass cleaning compositions may also provide antimicrobial and/or disinfectant compounds which will not adversely affect the viscosity of the compositions. The formulator may also choose to include one or more cleaning solvents. These cleaning solvents will typically be utilized in amounts from 0 to about 2.0 weight percent, preferably from about 0.01 to about 1.0 weight percent and most preferably, from about 0.1 to about 0.5 weight percent.

For better consumer acceptance, the glass cleaning composition will typically contain colorant or dye, such as Direct Blue 86, Liquitint® or Blue HP. If a dye or a fragrance is contained in the composition, it may be preferable also to include an antioxidant, such as potassium iodide, to protect these materials and provide sufficient stability for a long shelf life. Of course, it is certainly possible for commercial or other reasons to provide a clear composition by omitting a colorant or dye.

Compositions of the present invention are basic in order to neutralize the polymer. Accordingly, the pH of the composition is above 7, more preferably from about 8 to about 13 and ideally from about 8 to about 11.

The pH of the composition may be adjusted with an alkalinity agent. Amine containing alkalinity agents are preferred in cleaning compositions because their volatilization properties reduce the likelihood of residue (streaking) on the treated surface. More preferably, the alkalinity agent is selected from monoethanolamine, diethanolamine, triethanolamine and ammonia. Most preferably, the alkalinity agent is ammonia due to its relatively low cost and commercial availability.

Since the cleaning compositions of the present invention are water-based due to reasons of consumer safety, water comprises the balance of the compositions. Accordingly, water is generally present in an amount from about 1.0 to about 99.5 total weight percent, more preferably in an amount from about 50 to about 99.5 total weight percent, and most preferably from about 85 to about 98 total weight percent.

The compositions of the present invention may be prepared using conventional methods. Preferably, the compositions are prepared by adding the polymer to a sufficient amount of water to disperse the polymer. Typically, the amount of water required to disperse the polymer is about 40 percent by weight of the total amount of water to be added to the composition. In addition, the dispersion is generally carried out under high agitation at temperatures between about 60° F. (about 15° C.) and 150° F. (about 66° C.), preferably between about 50° C. and about 60° C. The polymer can also be dispersed in water using an anionic or fluoro anionic surfactant. The neutralization of the polymer can be completed at any point after dispersion. The glycol ethers, linear alcohols and nonionic surfactants, if utilized, are not typically added until polymer is adequately dispersed.

EXAMPLES

The following compositions are either Illustrative Examples of various representative embodiments of the present invention or Comparative Examples thereof.

Example 1

A thickened glass cleaning composition according to the present invention was prepared by mixing the following components according to the following formula:

| | |
|---|---|
| Triethanolamine lauryl sulfate (40% active) | 0.2000 |
| Ethylene glycol n-hexyl ether | 0.8000 |
| Ethylene glycol n-butyl ether | 1.0000 |
| N-octyl sulfonate (Witconate ® NAS-8) | 0.1000 |
| Carbopol ® ETD 2623 | 0.0850 |
| Fragrance | 0.0417 |
| Dye | 0.0022 |
| Ammonia (30% active) | 0.4500 |
| Deionized water | balance |

The composition had a pH of about 10.5, and an initial viscosity of about 115 cps at 25° C.

Example 2

A thickened glass cleaning composition according to the present invention was prepared according to the following formula:

| | |
|---|---|
| Sodium lauryl sulfate (29% active) | 0.2670 |
| Ethylene glycol n-hexyl ether | 0.6000 |
| Ethylene glycol n-butyl ether | 0.8000 |
| Fluoro anionic surfactant (Fluorad ® FC-129) | 0.0125 |
| Carbopol ® ETD 2623 | 0.0700 |
| Propylene glycol | 0.1250 |
| Fragrance | 0.0417 |
| Dye | 0.0022 |
| Ammonia (30% active) | 0.3500 |
| Deionized water | balance |

The composition had a pH of about 10.3, and an initial viscosity of about 75 cps at 25° C.

Examples 3 & 4 and Comparative Examples 1–3

Thickened compositions were prepared according to Table 1.

TABLE 1

| Ingredient | Total Weight Percent | | | |
|---|---|---|---|---|
| | Example 3 | Example 4 | Comparative Example 1 | Comparative Example 2 |
| Sodium lauryl sulfate (29% active) | 0.267 | 0.267 | 0.267 | 0.267 |
| Ethylene glycol n-hexyl ether | 0.06 | 0.06 | — | — |
| Carbopol ® ETD 2623 | 0.07 | 0.09 | 0.07 | 0.09 |
| Ammonia (30% active) | 0.93 | 0.03 | 0.03 | 0.03 |
| Deionized Water | balance | balance | balance | balance |
| pH | 10.1 | 10.0 | 10.1 | 10.0 |

Evaluation

Glass cleaning compositions are evaluated for both vertical cling and ease of use properties.

Evaluation of Vertical Cling Properties

Surprisingly, Applicant has found that the cleaning products of the present invention advantageously provide vertical cling at polymer levels of about 0.1 or less total weight percent. Applicant has observed that the typical consumer is sensitive to the differences in viscosities of cleaning compositions. From this observation, and others, Applicant believes that a cleaning product is perceived by a typical consumer as having vertical cling (not runny) when it has a viscosity between about 20 and about 140 cps, preferably between about 50 to about 100 cps, and most preferably between about 60 and about 80 cps.

The viscosity of cleaning compositions of the present invention as well as the comparative examples were measured using a Brookfield LTV Viscometer at 60 RPM and a #2 spindle at a temperature of about 25° C. The results are illustrated in Table 2 below.

For evaluation by direct observation of the drip distance of the compositions of the present invention and the comparative examples, mirrors were prepared by cleaning with HPLC grade acetone with a paper towel and dried thoroughly.

Approximately 0.1 g of each composition was placed on the mirror using an eye-dropper. Each treated mirror was then oriented substantially perpendicular to the floor for approximately 15 seconds. The length of the drip for each product was then measured. The results are illustrated in Table 2 below.

TABLE 2

| | Viscosity (cps) | Drip Distance (cm) |
|---|---|---|
| Example 1 | 112 | 8.25 |
| Example 2 | 72 | 10.48 |
| Example 3 | 158 | 8.89 |
| Example 4 | 433 | 3.81 |
| Comparative Ex. 1 | 34 | 16.83 |
| Comparative Ex. 2 | 195 | 10.48 |

As illustrated by the above Table, the addition of an organic ether (Example 3) provides at least twice the viscosity versus a composition without an organic ether (Comparative Example 1) containing equivalent amounts of polymer. About 29% more polymer must be used (Comparative Example 2) in order to achieve a comparable viscosity of a polymer solution containing an organic ether (Example 3).

Evaluation of Ease of Use

Applicants have found that the formulations of the present invention enhance the ease of use by the consumer due to a reduction in the lateral force ("rub-out friction") between the cleaning implement and the surface. For purposes of this invention, the rub-out friction can be measured using the Precision Force Scrubber from the ADAM Instrument Co. of Blue Ash, Ohio.

The Precision Force Scrubber is a computer controlled mechanical scrubbing and polishing device. For the measurement of the rub-out friction of the invention, a polished glass mirror was the test surface used, and a dry paper towel was wiped by the machine across the test surface. The Precision Force Scrubber is designed to apply a fixed normal force while monitoring the lateral frictional force throughout the scrubbing action. The number of scrubbing cycles, the acceleration and velocity of the scrubber head are displayed and controlled by a graphical display interface. Data gathering and analysis software are provided to allow characterization of the applied forces throughout each scrubbing stroke and during multiple stroke cycles. Thus, cleaning, polishing, stripping and other such procedures can be reproducibly controlled and sensitively monitored.

The normal force is the downward force applied by the scrubber head. The lateral force represents the forces of friction between the stationary glass mirror and the moving scrubbing towel. This lateral force is also known as "rub-out" friction. The presence of an undesirably high coefficient of static friction or "tack" is represented graphically by a peak in the lateral force graph.

The controlled scrubber head was equipped with a 2" by 4" (about 5 cm by 10 cm) scrubber. Strips of 1.5" (about 4 cm) wide of paper towel were attached to each scrubber head. The settings on the Precision Force Scrubber were as follows: wait state 0 sec., velocity 10, acceleration and deceleration 100, 10 cycles with a 7 inch (about 17.8 cm) stroke and 5 lb. normal force. These settings were chosen as representative of the normal force of friction between stationary glass and the moving scrubbing pad as applied by a typical consumer.

Approximately 1.0 g. of each test product was applied to the front surface of each cleaning pad. This procedure was used to obtain a machine controlled comparison of the test products on a standard 12" (about 30.5 cm) square glass mirror.

To illustrate the enhanced reduction in rub-out friction of the present invention, the compositions of Examples 2–4 containing polymer levels less than 1 total weight percent and about 0.6% by weight of organic ether were compared to Comparative Examples 1 and 2 containing no organic ether. The lateral (rub-out) force (lb.) data from the Precision Force Scrubber was plotted against time (sec) as shown in FIGS. 1–3.

FIG. 1 illustrates the rub-out friction for Example 3 of the invention containing 0.07% by weight polymer and 0.6% by weight ethylene glycol n-hexyl ether (plot 1) versus the composition of Comparative Example 2 containing 0.09% by weight polymer and no organic ether (plot 2), for about 8 cycles between 0 and 15 seconds. Applicant notes that the artifacts appearing in plot 2, between about 6.5 and 15 seconds are due to the breakage of the paper towel during those scrubbing cycles. As shown, the inventive composition containing the organic ether provided an improved reduction of rub-out friction of about 0.5 lb. as compared to the formula without the organic ether.

Figure 2:
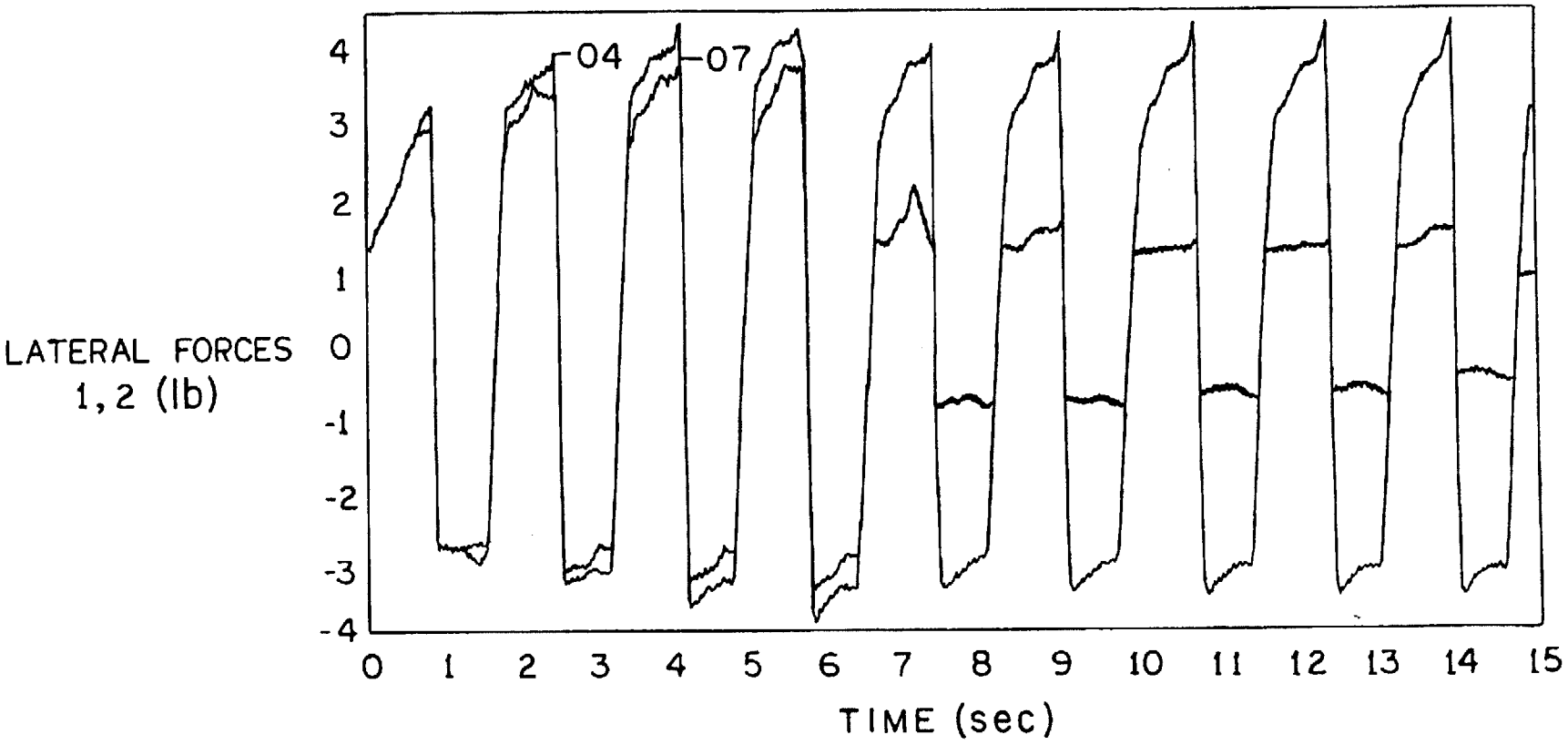

FIG. 2 illustrates the rub-out friction for Example 3 of the invention containing 0.07% by weight polymer and 0.6% by weight ethylene glycol n-hexyl ether (plot 1) versus Comparative Example 1 containing 0.07% by weight polymer and no organic ether (plot 4), for about 8 cycles between 0 and 15 seconds. Applicant notes that artifacts appearing in plot 4 between about 6.5 and 15 seconds were caused by the breakage of the paper towel during those scrubbing cycles. The inventive composition containing the organic ether provided an improved reduction of rub-out friction of about 0.3 lb. as compared to the formula without the organic ether.

Figure 3:
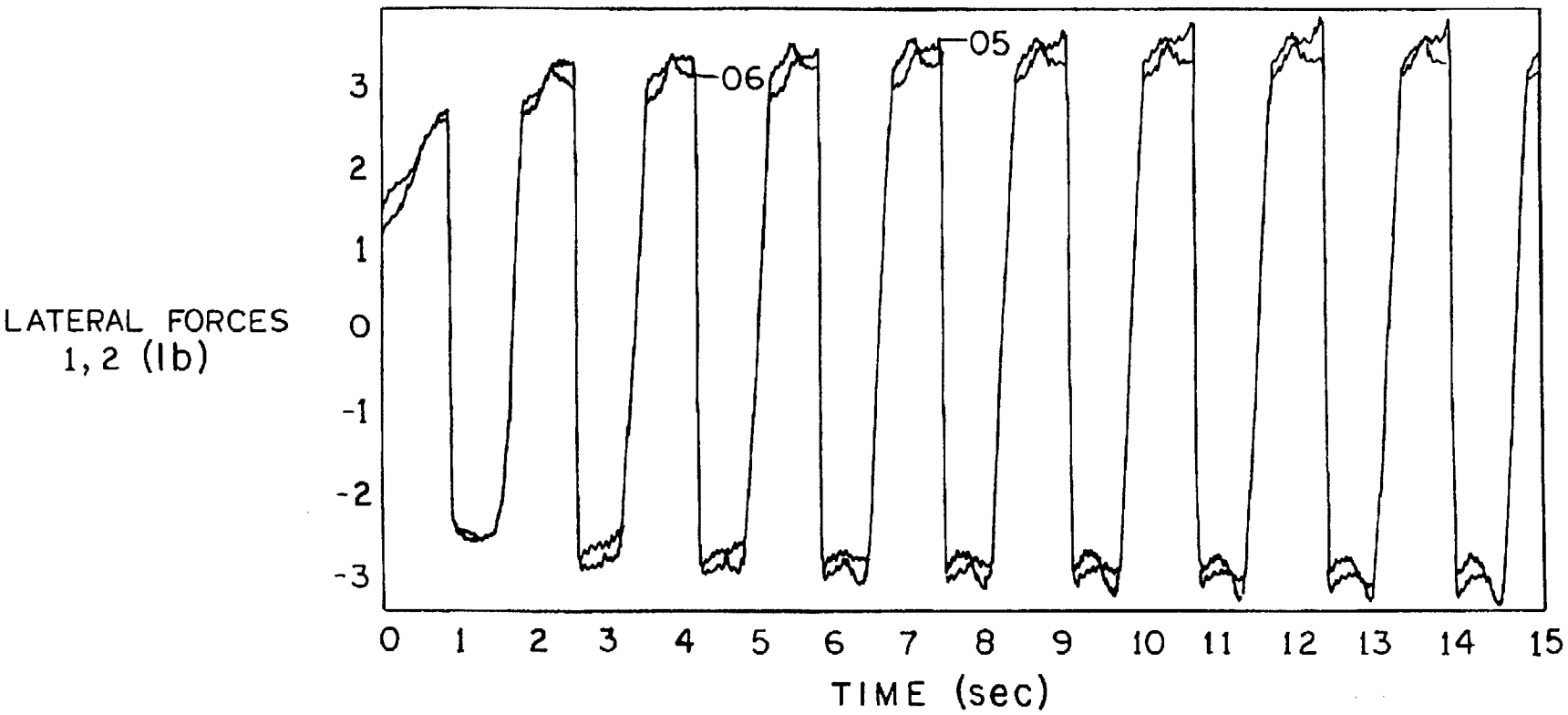

FIG. 3 illustrates the rub-out friction for Example 4 of the invention containing 0.09% by weight polymer and 0.6% by weight ethylene glycol n-hexyl ether (plot 5) versus Example 2 of the invention containing 0.07% by weight polymer, 0.6% by weight ethylene glycol n-hexyl ether and 0.8% by weight ethylene glycol n-butyl ether (plot 6), for about 8 cycles between 0 and 15 seconds.

As clearly demonstrated by the results of the above-described vertical cling and ease of use evaluations, the compositions of the present invention provide both vertical cling and improved ease of use at low levels of polymers.

Industrial Applicability

Accordingly, the compositions of the present invention advantageously provide vertical cling and improved ease of use properties to glass and other surfaces such as vinyl, plastic, porcelain, ceramics, and metal. These compositions may be dispensed from conventional trigger spray dispensers and the like.

Although the present invention has been illustrated with reference to certain preferred embodiments, it will be appreciated that the present invention is not limited to the specifics set forth therein. Those skilled in the art readily will appreciate numerous variations and modifications within the spirit and scope of the present invention, and all such variations and modifications are intended to be covered by the present invention which is defined by the following claims.

I claim:

1. A composition for cleaning glass, comprising:

water;

a synthetic cross-linked polymeric agent with high thickening efficiency in an amount less than or equal to about 0.1 total weight percent;

at least one compound selected from the group consisting of nonionic surfactants, linear alcohols, an organic ether having the formula:

$$R_1—O—R_2$$

wherein $R_1$ is a $C_1$–$C_8$ linear, branched or cyclic alkyl or alkenyl optionally substituted with —OH, and $R_2$ is a $C_1$–$C_6$ linear, branched or cyclic alkyl or alkenyl substituted with —OH, and mixtures thereof; and an anti-streaking alcohol having the formula

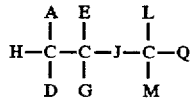

wherein A, D, E, G, L and M are independently —H, —$CH_3$, —OH or —$CH_2OH$; J is a single bond or —O—; and Q is —H or a straight chain or branched $C_1$–$C_5$ alkyl optionally substituted with —OH, with the proviso that:

(i) if Q is not alkyl substituted with —OH, then at least one of A, D, E, G, L and M is —OH or —$CH_2OH$;

(ii) when only one of A and E is —OH and J is a single bond, D, G, L, M and Q may not be —H simultaneously;

(iii) when A, D, E, G and L are —H simultaneously, J is a single bond and M is —$CH_2OH$, Q may not be —H or $$-\underset{\underset{OH}{|}}{CH}CH_2CH_2CH_3;$$

and (iv) when J is a single bond, none of E, G, L and M is —$CH_3$ or —$CH_2OH$ and Q is —$CH_2CH_2CH_2CH_3$, then at least two of A, D, E, G, L and M are —OH, or at least one of A and D is —CH or —$CH_2OH$, the composition having a pH of at least 7, and a viscosity in the range of at about 20 centipoise to about 140 centipoise.

2. The glass cleaning composition according to claim 1, wherein said polymer is selected from the group consisting of polyacrylic acid polymers, polyacrylic copolymers, acrylic polymers, acrylic copolymers and mixtures thereof.

3. The glass cleaning composition according to claim 2, wherein said polymer is present in an amount from about 0.02 to about 0.1 total weight percent.

4. The glass cleaning composition according to claim 2, wherein said polymer is present in an amount from about 0.05 to about 0.09 total weight percent.

5. The glass cleaning composition according to claim 1, wherein said compound is an organic ether and wherein $R_1$ is an optionally substituted $C_3$–$C_6$ alkyl or alkenyl, and $R_2$ is a monosubstituted $C_2$–$C_4$ linear or branched alkyl or alkenyl.

6. The glass cleaning composition according to claim 5, wherein $R_1$ is an unsubstituted or monosubstituted linear or branched $C_3$–$C_6$ alkyl, and $R_2$ is a monosubstituted $C_2$–$C_4$ linear or branched alkyl.

7. The glass cleaning composition according to claim 6, wherein $R_1$ is an unsubstituted n-$C_3$–$C_4$ or n-$C_6$ linear alkyl or $$-CH_2\underset{\underset{OH}{|}}{CH}CH_3,$$

and $R_2$ is —$CH_2CH_2OH$ or $$-CH_2\underset{\underset{OH}{|}}{CH}CH_3.$$

8. The glass cleaning composition according to claim 5, wherein said organic ether comprises ethylene glycol n-hexyl ether in an amount from about 0.01 to about 1.5 total weight percent and ethylene glycol n-butyl ether in an amount from about 0.01 to about 3.5 total weight percent.

9. The glass cleaning composition according to claim 5, wherein said organic ether comprises ethylene glycol n-hexyl ether in an amount from about 0.1 to about 1.0 total weight percent and ethylene glycol n-butyl ether in an amount from about 0.1 to about 3.0 total weight percent.

10. The glass cleaning composition according to claim 5, wherein said organic ether comprises ethylene glycol n-hexyl ether in an amount from about 0.6 to about 0.9 total weight percent and ethylene glycol n-butyl ether in an amount from about 0.8 to about 2.0 total weight percent.

11. The glass cleaning composition according to claim 1, wherein said compound is a nonionic surfactant selected from the group consisting of ethoxylated nonylphenols, linear alcohol ethoxylates and mixtures thereof.

12. The composition for cleaning glass according to claim 11, wherein said nonionic surfactant is selected from the group consisting of $C_9$–$C_{15}$ linear alcohol ethoxylates, ethoxylated nonylphenols having 9 to 15 moles of ethylene oxide, and mixtures thereof.

13. The glass cleaning composition according to claim 11, wherein said nonionic surfactant is present in an amount from about 0.01 to about 0.5 total weight percent.

14. The glass cleaning composition according to claim 14, wherein said nonionic surfactant is present in an amount from about 0.01 to about 0.1 total weight percent.

15. The glass cleaning composition according to claim 1, wherein said compound is a linear alcohol.

16. The glass cleaning composition according to claim 1, wherein at least one of A, D, E and G is —OH or —$CH_2OH$.

17. The glass cleaning composition according to claim 16, wherein one or two of A, D, E and G is —OH or —$CH_2OH$, and Q is —H or —$CH_2OH$.

18. The glass cleaning composition according to claim 17, wherein J is —O—, L and M are independently —H or —$CH_3$, and Q is —$CH_2OH$.

19. The glass cleaning composition according to claim 1, wherein said organic ether is present in the amount from about 0.01 to about 5.0 total weight percent and said anti-streaking alcohol is present in the amount of from about 0.1 to about 1.0 total weight percent.

20. The glass cleaning composition according to claim 1, wherein said organic ether is present in the amount of from about 0.5 to about 3.0 total weight percent and said anti-streaking alcohol is present in the amount of from about 0.1 to about 0.5 total weight percent.

21. The glass cleaning composition according to claim 1, wherein said organic ether is present in the amount of about 2.0 or less total weight percent and said anti-streaking alcohol is present in the amount of about 0.125 total weight percent.

* * * * *